US005513665A

United States Patent [19]

Chan

[11] Patent Number: 5,513,665

[45] Date of Patent: May 7, 1996

[54] HAIR CURLING APPARATUS

[75] Inventor: Wing-Kin Chan, Kowloon, Hong Kong

[73] Assignee: China Pacific Trade Limited, Virgin Islands (Br.)

[21] Appl. No.: 250,832

[22] Filed: May 31, 1994

[51] Int. Cl.[6] ..... A45D 6/06

[52] U.S. Cl. ..... 132/228; 132/227

[58] Field of Search ..... 132/226, 227, 132/228, 229, 232

[56] References Cited

U.S. PATENT DOCUMENTS

| | | | |
|---|---|---|---|
| 4,260,871 | 4/1981 | Nagelkerke | 219/222 |
| 4,267,851 | 5/1981 | Plaisted | 132/229 |
| 4,456,815 | 6/1984 | Andis | 219/225 |
| 4,496,825 | 1/1985 | Andis | 219/222 |
| 4,564,032 | 1/1986 | Araki | 132/229 |
| 4,687,010 | 8/1987 | Caruso | 132/229 |
| 5,212,366 | 5/1993 | McDougall | 219/222 |
| 5,365,037 | 11/1994 | Chan | 219/222 |

*Primary Examiner*—John G. Weiss
*Attorney, Agent, or Firm*—Burns, Doane, Swecker & Mathis

[57] ABSTRACT

Hair curling apparatus comprises a curling iron that can be inserted in a curling roller. The curling iron has a shaft for insertion in the roller formed by a number of elongate plate-like members, and the interior surface of the roller is formed with corresponding slots for receiving the edges of the plate-like members. Thus the curling iron may be easily located and secured within the roller. In another embodiment the curling iron is provided with a projection in an end face of the handle, the projection being received within a corresponding aperture formed in an end member of the roller.

4 Claims, 5 Drawing Sheets

HAIR CURLING APPARATUS

FIELD OF THE INVENTION

This invention relates to a hair curling apparatus.

BACKGROUND OF THE INVENTION

One well known device for use in curling hair is a cuffing drum. The device comprises a cylindrical drum, and a cover or sleeve which is snap fit on the drum. In use the drum and sleeve are heated in a heating apparatus. When they have been heated, they are brought to the hair, the hair is curled around the drum, and the sleeve is fitted over the drum to retain the hair in the cuffed configuration. As the drum and sleeve gradually cool down, they warm the hair which then retains the curled configuration upon subsequent removal of the drum and sleeve.

There are a number of disadvantages with hair curling drums. The principal disadvantage is that the operation of curling the hair is laborious for the hairdresser, and lengthy for the person whose hair is being curled. Additionally the results may not always be as desired. These disadvantages arise because the drum and the sleeve cannot usually store sufficient heat to effect complete curling. Thus the hairdresser must remove the cooled drum and replace it with a heated drum, and this cycle of removal and replacement must be carried out repeatedly, which is very laborious for all parties concerned. Furthermore, during removal and replacement, some of the hairs which were curled around the drum being removed may escape being curled around the replacement drum, and vice versa. Additionally in the final cycle of operation the hair may become overcurled.

A second well-known device for use in curling hair is a curling iron. This device comprises a perforated barrel, a housing at one end of the barrel which serves firstly as a handle for the device, and secondly contains an electrically powered mechanism for generating a stream of hot air which is blown axially along the barrel, and a retaining finger extending from the housing along the length of the barrel. In operation, the curling iron is connected to a power supply by means of an electrical lead, is brought to the hair, the retaining finger is withdrawn from the barrel, the hair is curled around the barrel, the retaining finger is returned to its operational position to retain hair curled around the barrel, and the device is activated to blow hot air along the barrel and through its perforations so as to curl the hair. Hair cuffing irons however suffer from their own disadvantages. If a large number of curls are required, either a large number of curling irons must be used, which would be expensive and would require the person whose hair is being curled to bear the weight of all those irons, or alternatively a single iron must be moved sequentially from place to place in the person's hair, which is time consuming.

PRIOR ART

To overcome these problems apparatus has been proposed (UK patent application 9003785.4) comprising a handle, including a heater blower assembly for producing a stream of heated air, an elongate barrel for insertion into a hair curling roller located in a person's hair and being hollow with apertures defined along its length for delivering a stream of heated air to the roller and to the hair wound thereon. Such apparatus can be moved sequentially from roller to roller located in the user's hair to deliver a charge of heat to individual curling rollers. One disadvantage of this proposed apparatus however is that retention means are required to secure the barrel in place when inserted in a roller. In UK patent application 9003785.4 this retention means takes the form of a clip provided on the housing which engages an aperture formed on a collar of line roller. This arrangement is not ideal since it requires actuation to engage and disengage the clip from the roller, and in use this can be awkward and time consuming when moving from one roller to another.

SUMMARY OF THE INVENTION

According to the present invention there is provided hair curling apparatus comprising, a hair curling iron comprising a handle including therein a heater blower assembly for producing a stream of heated air, an elongate shaft member extending from said housing, and a hair curling roller, wherein said roller is provided with means for engaging said shaft member.

By means of this arrangement the requirement for a seperate retention means is avoided and the shaft member may be located in place in a roller by means of the engaging means provided in the roller itself.

In a preferred arrangement the shaft member comprises a plurality of elongate plate-like members extending in the direction of the axis of the shaft member, and said engaging means comprises a plurality of slots formed on the inner surface of the roller parallel to the axis thereof for engaging the edges of said plate-like members. For example the shaft member may be formed of three such plate-like members arranged to define a shaft member having a trianglar cross-section, and the interior of the roller may be provided with three corresponding slots. In a preferred embodiment, however, the shaft member may comprise four such plate-like members arranged to define a cruciform cross-section, and the inner surface of the roller may be provided with four corresponding slots for engaging the shaft member.

In a preferred embodiment the shaft member extends from the handle along the central longitudinal axis thereof along which the stream of air is directed. Preferably therefore means are provided to deflect the stream of air radially of the shaft member whereby the air may pass through apertures provided in the cylindrical surface of the roller to contact hair wound thereon in use.

Preferably such deflecting means may comprise a series of baffles provided along the axis of the shaft member, preferably at right angles to the axis. It is particularly preferred that the baffles become progressively larger the further away from the handle they are disposed along the axis of the shaft member.

Viewed from a further aspect the invention extends to a hair curling iron comprising a handle including therein a heater blower assembly for producing a stream of heated air, and an elongate shaft member formed from at least one plate-like member extending in the direction of the axis of the shaft member.

Viewed from a still further aspect the invention extends to a hair curling roller comprising a cylindrical inner surface having at least one slot therein extending parallel to the central axis of the roller for receiving a shaft member of a hair curling iron.

In another form of the invention there is provided hair curling apparatus comprising, a hair curling iron comprising a housing including therein a beater blower assembly for producing a stream of heated air, said housing including an end face, said apparatus further comprising an elongate shaft member extending from said end face of said housing, and a hair curling roller comprising a generally cylindrical roller body and a pair of end members, wherein projecting means are provided on said housing end face adjacent the end of said elongate shaft member for engaging an aperture defined in at least one of said roller end members.

By means of this arrangement there is provided an alternative arrangement having a very simple manner of engaging the shaft member in the roller. The act of inserting the shaft member in the roller will simultaneously cause the projecting means on the housing to engage in the aperture of the roller end member.

Preferably at least one such aperture is provided in each member of the roller so that it does not matter which way the shaft member is inserted in the roller. Also preferably means are provided whereby the shaft member may be located in the roller in a number of different relative rotational orientations in order that the shaft member does not have to be inserted into the roller in one specific position. For example this may be achieved by providing a plurality of apertures disposed in a circular array about the central axis of the cylindrical roller whereby the projecting means, for example a pin, may engage any one of the apertures. Alternatively the projection may be centrally located on the end face of the housing and have a polygonal cross-section, with the aperture on the end member of the roller also being centrally located about the axis of the roller and having a polygonal cross-section corresponding to that of the projecting means. For example the projecting means and the aperture may be pentagonal, hexagonal or heptagonal. The dimensions of the polygonal projection are preferably such that the projection tapers away from the end face whereby the roller will be securely engaged in use by means of a tight fit.

Viewed from a further aspect the present invention provides a hair curling iron comprising a housing including therein a heater blower assembly for producing a stream of heated air, said housing including an end face, and an elongate shaft member extending from said end face, wherein adjacent said shaft member the housing is also provided on the end face with projecting means extending parallel or coaxially with said shaft member for engaging a hair curling roller.

Viewed from a still further aspect the present invention provides a hair curling roller comprising a cylindrical body and two end members, each of said end members surrounding a central opening and each being provided with either a plurality of apertures arranged in a circular array about said central opening, or a single aperture coaxial with said central opening, for engaging a hair curling iron.

BRIEF DESCRIPTION OF THE DRAWINGS

Some embodiments of the present invention will now be described by way of example and with reference to the accompanying drawings, in which.

DETAILED DESCRIPTION OF PREFERRED EMBODIMENTS

Figure 1:
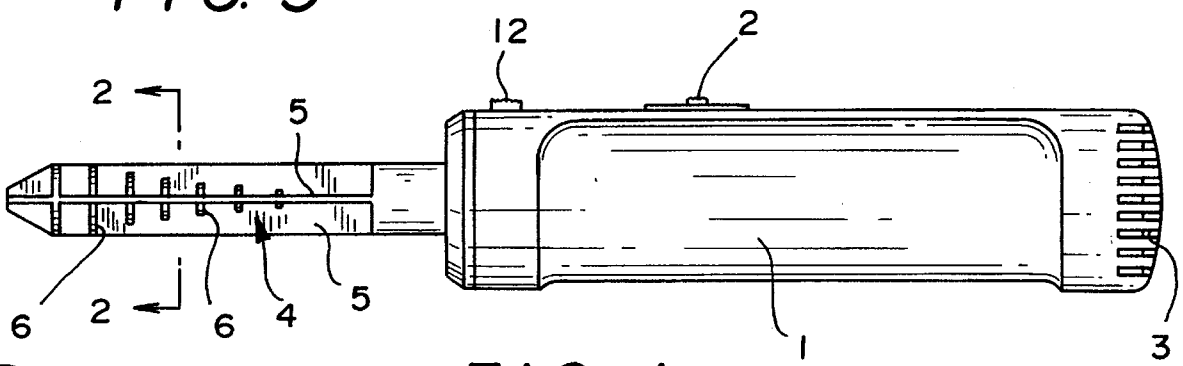
FIG. 1 is a side view of a hair curling iron.
Figure 2:
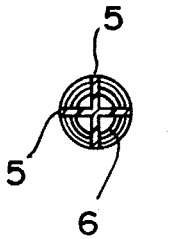
FIG. 2 is a sectional view along line 2—2 of FIG. 1.
Figure 6:
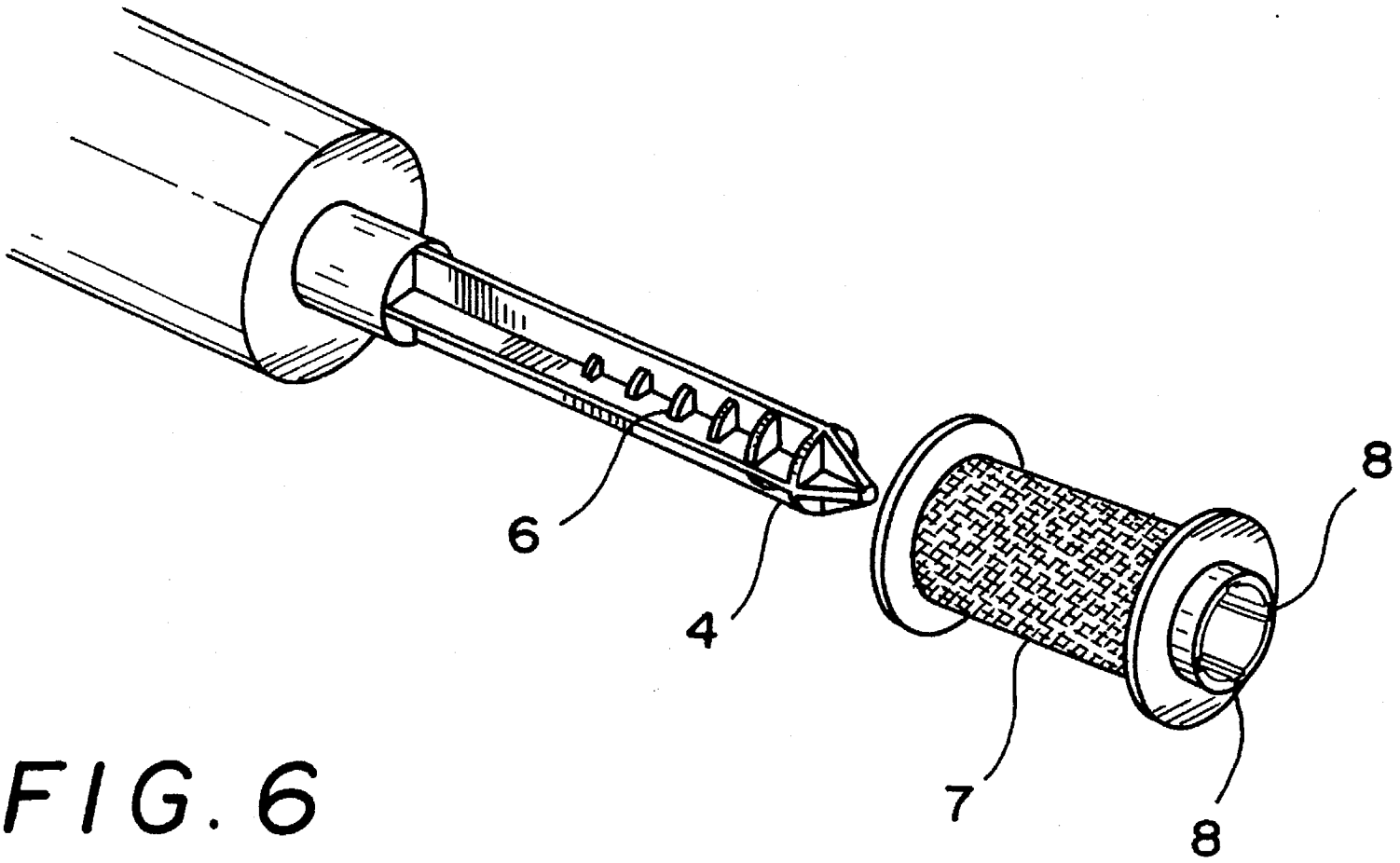
FIG. 6 is a perspective view illustrating the shape of the shaft member.

Referring firstly to FIG. 1 there is shown a hair curling iron comprising a handle 1. Housed within the handle 1 is a conventional electrically powered heater/blower assembly operated by a slide switch 2. In use the heater/blower assembly draws air into the handle through rear air inlet 3 and generates a stream of heated air that is directed out of the handle along the axis thereof to the left as viewed in the Figures.

A shaft member 4 is connected to the handle 1 and extends along the axis thereof in the direction of the stream of heated air. The shaft member 4 has a cruciform cross-section and may be considered to be defined by two intersecting elongate plates 5, though it could equally be considered to be defined by four elongate plates that meet along their respective edges. However they are viewed, at their extreme left-hand ends (as viewed in the Figures), the ends remote from the handle, the plates come together to form a point.

Along the length of the shaft member 4 is provided a series of baffles. Each baffle 6 is disposed such that its centre lies along the axis of the shaft member 4, with the shaft axis being normal to the plane of the baffles 6. The surface area of the respective baffles 6 becomes progressively larger from baffle to baffle as one moves along the shaft member toward the end remote from the handle 1.

In use the shaft member 4 is inserted in a roller 7 about which hair to be curled is wound. The interior surface of the roller 7 is generally cylindrical but includes four slots 8 disposed parallel to the central axis of the roller at positions corresponding to the edges of the plates 5, that is to say in this embodiment they are disposed equiangularly about the inner surface of the roller 7. The shaft member 4 is inserted in the roller 7 by locating the edges of the plates 5 in the four slots 8. This provides a sufficiently secure engagement between the shaft member 4 and the roller 7 and no further retention means is required.

In operation the heater/blower assembly is switched on to generate a stream of hot air along the axis of the shaft member 4. This stream of air is then progressively deflected by the baffle plates 5 radially of the shaft member 4 so that it may pass through apertures 9 provided in the roller and may then act upon the hair wound round the roller to produce a curl. A plurality of rollers may be placed in a user's hair and the curling iron may be moved from roller to roller sequentially supplying a charge of heat to each roller in turn, with the rollers remaining in place until the curls are formed. The act of inserting the shaft member in the roller is considerably facilitated by the simple yet effective manner of the engagement between the shaft member and the roller that does away with the need for seperate retention means.

Figure 3:
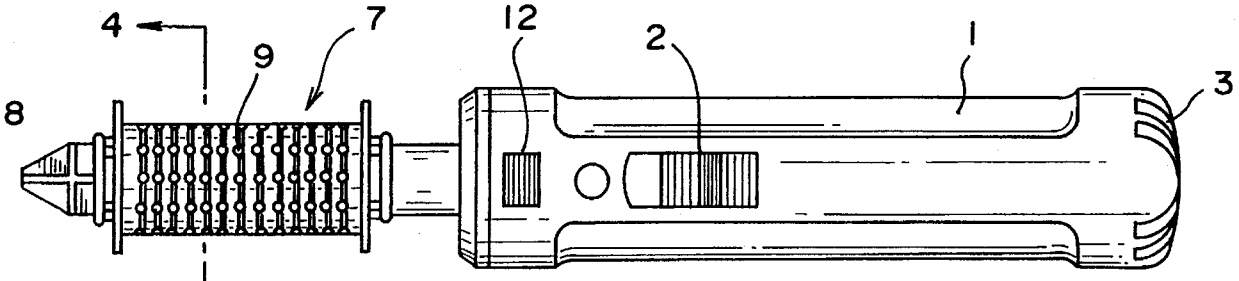
FIG. 3 is a top view of a hair curling iron inserted inside a roller.
Figure 4:
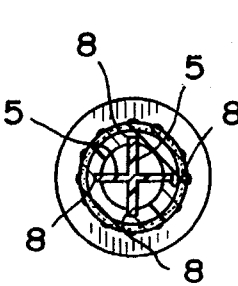
FIG. 4 is a sectional view along line 4—4 of FIG. 3.
Figure 5:
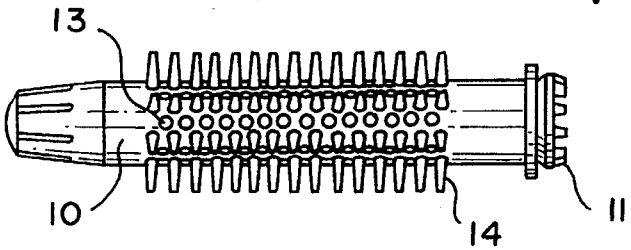
FIG. 5 is a side view of an alternative construction.

As is shown in FIG.5, the apparatus is versatile and instead of the roller of FIGS.3 and 4 the shaft member 4 may be inserted within a brush sleeve 10 the interior of which is provided with engaging slots corresponding to those of the roller 7. Such a brush sleeve 10 may be fixed in place over the shaft member by engaging lugs 11 formed at one end of the sleeve 10 in corresponding portions of the handle 1. A release button 12 may be provided on the handle to subsequently release the sleeve 10. The sleeve is provided with a plurality of apertures 13 for the exit of the hot air, and a plurality of brush means 14.

Figure 7:
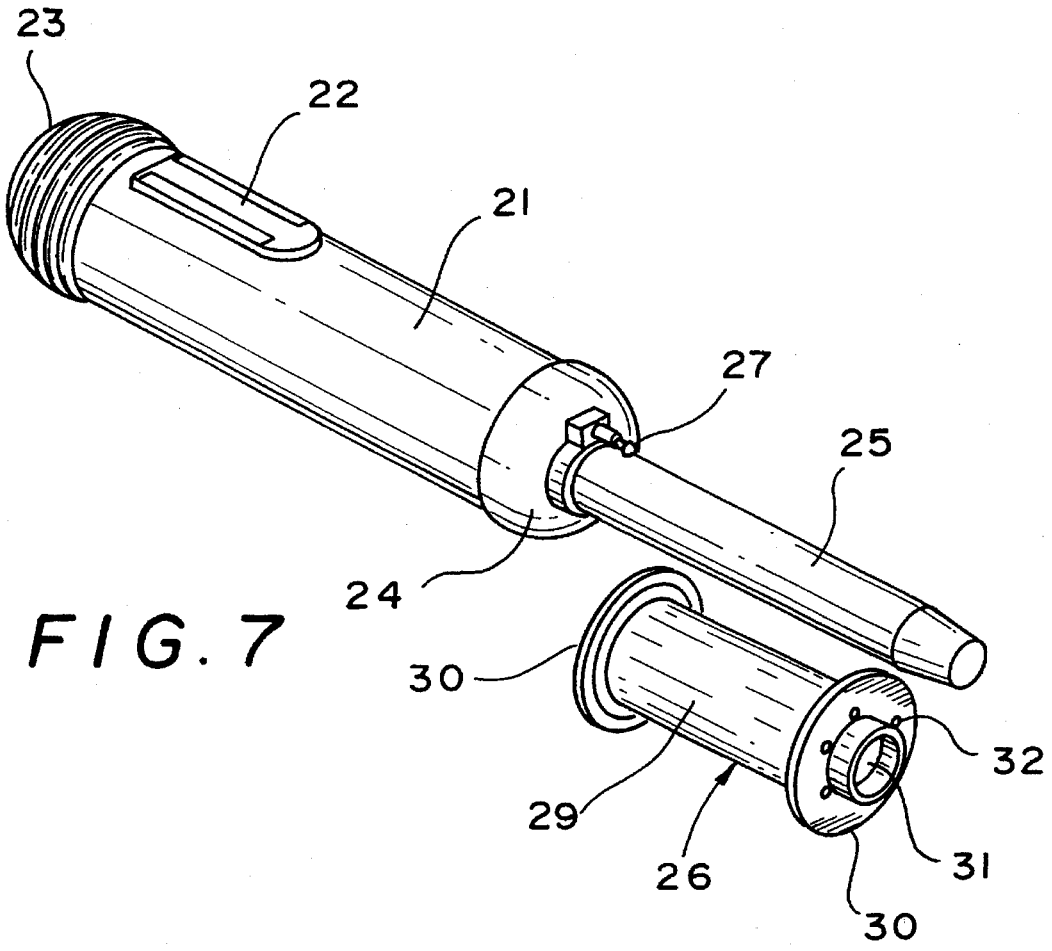
FIG. 7 is a perspective view of another embodiment of the invention with the shaft member removed from the roller.
Figure 8:
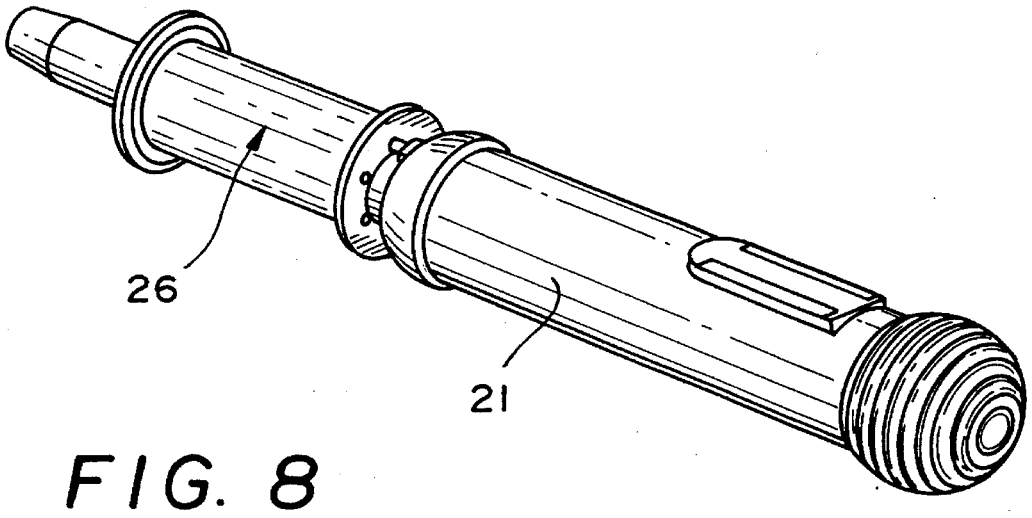
FIG. 8 is a perspective view of the embodiment of FIG. 8 looking in the opposite direction from FIG. 7, showing the roller engaged on the shaft member.
Figure 9:
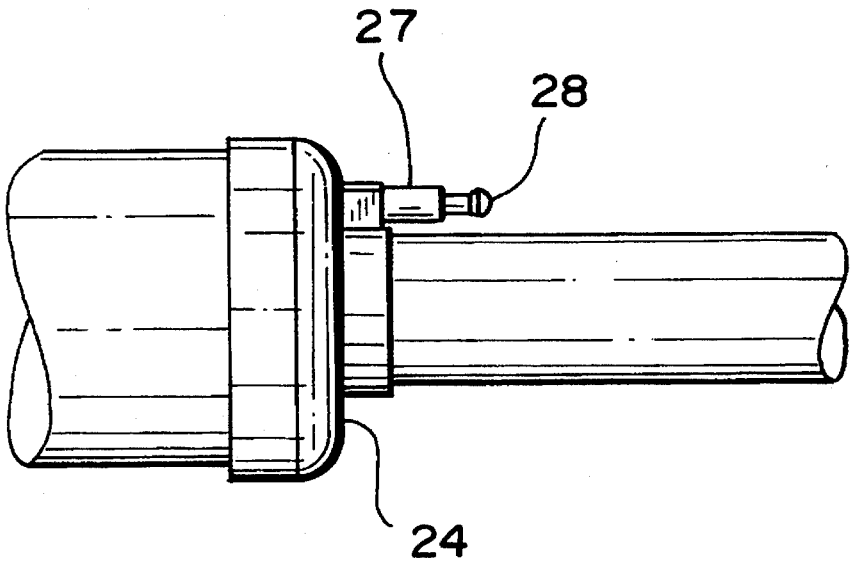
FIG. 9 is a side view of the embodiment of FIG. 7 showing the region of the end face of the housing but without a roller.
Figure 10:
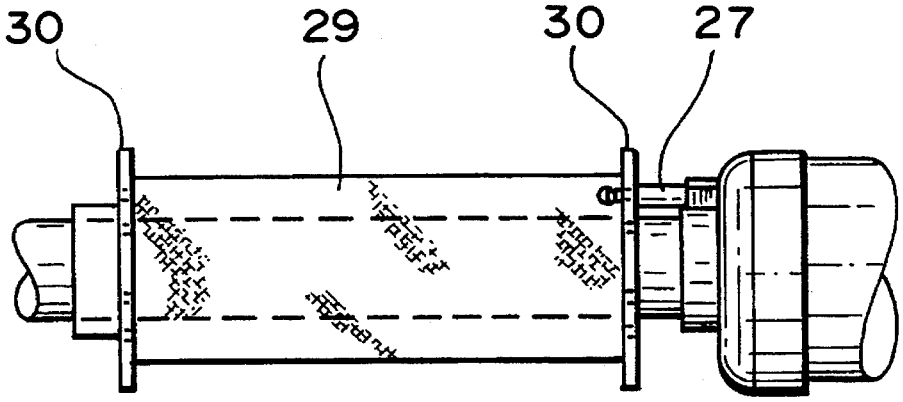
FIG. 10 is a view similar to FIG. 9 but including the roller.

Turning now to FIG.7 there is shown a hair curling iron comprising a handle 21. Located within the handle 21 is a conventional electrically powered heater/blower assembly operated by a slide switch 22. In use the heater/blower assembly draws air into the handle 21 through rear air inlet 23. The handle 21 is provided with an end face 24 at the end remote from the air inlet 23. Extending from this end face 24 is an elongate shaft member 25 in the form of a barrel element. In operation the heater/blower assembly draws air through the air inlet 23 and expels heated air into the elongate shaft member 25, Although not .shown in the drawings, the shaft member 25 is provided with an arrangement of apertures that permit the heated air to be expelled for application to the hair when the shaft member 25 is inserted in a roller 26 around which tile hair is curled.

As can be seen from FIGS.7 to 10, a dowel pin 27 is provided extending from the end face 24 of the handle 21, The pin 27 is provided adjacent the end of the shaft member 25 and extends parallel thereto. As can be seen particularly in FIG.9 the pin 27 is provided with a head 28. If desired the head 28 may be slightly enlarged. The roller 26 comprises a generally cylindrical body 29 and two end members 30 in the form of annular flanges surrounding the central opening 31 for receiving in use the shaft portion 25. The end members 30 are each provided with a plurality of holes 32, in this case six, arranged in a circular array around the central opening 31. The holes are preferably slightly smaller than the enlarged head 28 of the pin 27.

It will be understood that when the shaft member 25 is inserted into the roller 26 through the central opening 31, the head 28 of the pin 27 passes through one of the holes 32 and, because of the enlarged size of the head 28, the shaft member 25 is firmly engaged in the roller 26. The dimensions of the head 28 of the pin 27 and the holes 32 in the roller are of course chosen so that while a firm engagement of the shaft member in the roller is provided, at the same time the shaft member can easily be removed when desired. It will be understood that the pin 27 can pass through whichever of the holes 32 is most conveniently located.

Figure 11:
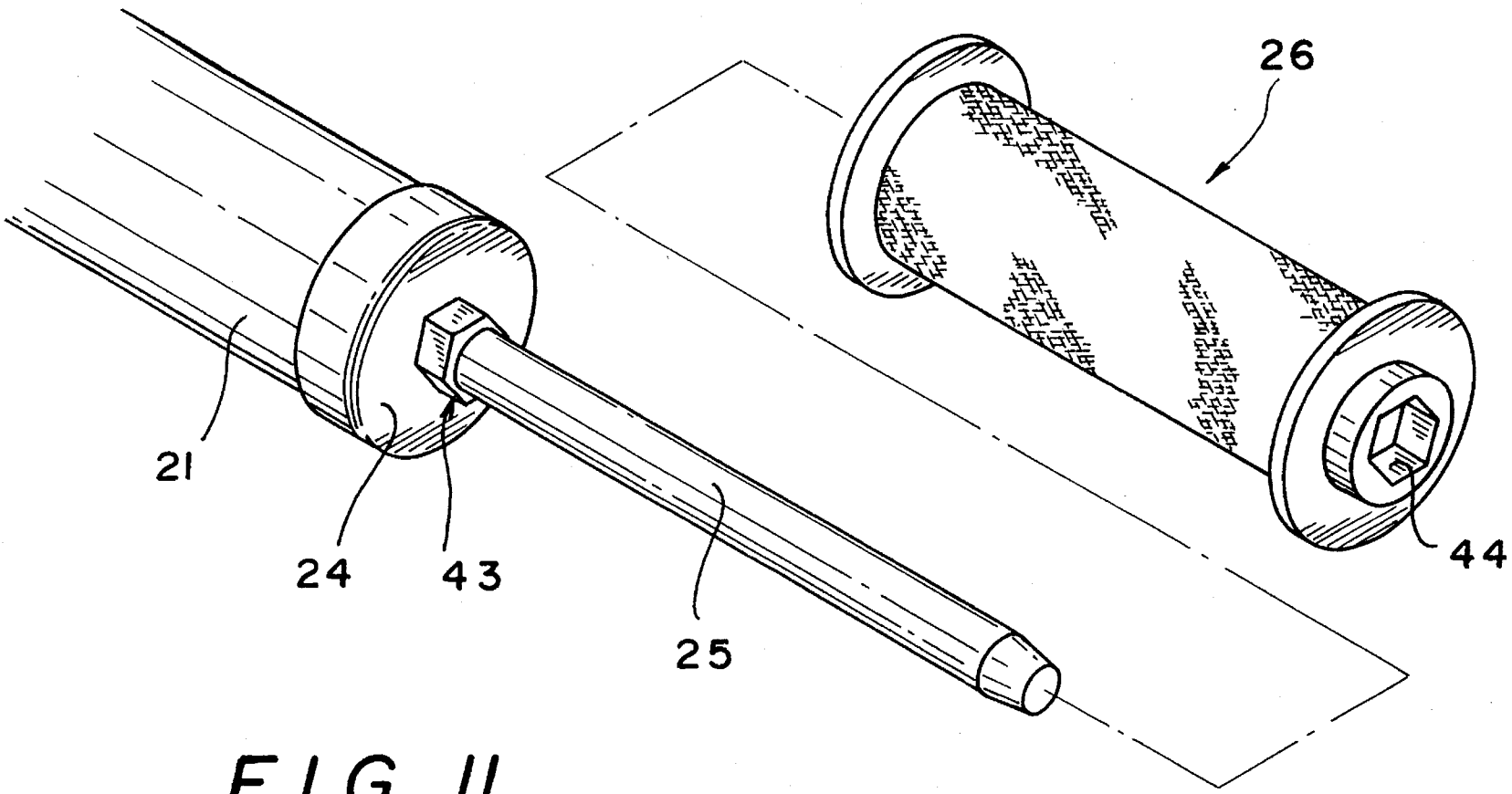
FIG. 11 is a perspective view similar to FIG. 7 but showing a further embodiment of the invention.

Referring to FIG. 11 there is shown a further embodiment in which the pin 27 is replaced by a projection in the form of a polygonal block 43 that extends from the end face 24 of the handle 21 and which is centred on the central axis of the housing 21 so that it surrounds the end of the shaft member. In the embodiment shown the projection 43 is hexagonal in cross-section,, though clearly other cross-sections are also possible. It should also be noted that the cross-section of the block 43 tapers away from the end face 24 of the handle 21. That is to say the dimensions of the sides of the polygon are greater closer to the end face.

As will also be seen from FIG. 11 the end members of the roller are each 10 provided with a correspondingly shaped polygonal aperture 44 surrounding and coaxial with the shaft receiving aperture of the roller. Upon insertion of the shaft member 25 in the roller 26 the polygonal aperture 44 engages the polygonal projection 43 and, by virtue of the taper provided on the projection 43, a secure tight fit is provided which securely engages the roller on the shaft member. It will also be understood that the polygonal shape of the projecting means and the corresponding aperture allows the projection to engage the aperture in as many relative rotational positions as there are sides of the polygon in question. In the embodiment of FIG. 11 the polygon is a hexagon giving six different engaging positions.

I claim:

1. A hair curling apparatus comprising, a hair curling iron including a handle having therein a heater/blower assembly for producing a stream of heated air, an elongate shaft member which extends from said handle along the central axis of the handle, and along which the stream of heated air is directed in use, and means to direct the stream of air radially of the shaft member, comprising a series of baffles disposed along the shaft member with the axis of the shaft member being disposed normal to the planes of the baffles, and a hair curling roller, wherein said roller is provided with means for engaging said shaft member.

2. Apparatus as claimed in claim 1 wherein said baffles become progressively larger toward the end of the shaft member remote from the handle.

3. A hair curling apparatus comprising, a hair curling iron including a handle having therein a heater/blower assembly for producing a stream of heated air, said handle including an end face, said apparatus further comprising an elongate shaft member extending from said end face of said handle, and a hair curling roller comprising a generally cylindrical roller body and a pair of end members, and further including projecting means provided on said handle end face adjacent an end of said elongate shaft member for engaging an aperture defined in at least one of said roller end members, wherein each said end member includes a circular array of apertures arranged about the central axis of the roller body, and said projecting means comprises a pin extending parallel to said shaft member, and wherein said pin is formed with an enlarged head.

4. A hair curling apparatus comprising, a hair curling iron including a handle having therein a heater/blower assembly for producing a stream of heated air, said handle including an end face, said apparatus further comprising an elongate shaft member extending from said end face of said handle, and a hair curling roller comprising a generally cylindrical roller body and a pair of end members, and further including projecting means provided on said handle end face adjacent an end of said elongate shaft member for engaging an aperture defined in at least one of said roller end members, wherein each said end member comprises a polygonal aperture coaxial with the central axis of the roller body, and said projecting means has a polygonal cross-section coaxial with said shaft member, and wherein said polygonal projection tapers away from said end face.

* * * * *